US008216095B2

(12) United States Patent
Weber et al.

(10) Patent No.: US 8,216,095 B2
(45) Date of Patent: Jul. 10, 2012

(54) ARTIFICIAL PITCHING SURFACE

(76) Inventors: Edward A. Weber, Antioch, IL (US); Jane L. Weber, legal representative, Antioch, IL (US); Gene Glas, Union Grove, WI (US); James Ronald Gillespie, Antioch, IL (US)

( * ) Notice: Subject to any disclaimer, the term of this patent is extended or adjusted under 35 U.S.C. 154(b) by 118 days.

(21) Appl. No.: 12/167,312

(22) Filed: Jul. 3, 2008

(65) Prior Publication Data

US 2009/0011873 A1 Jan. 8, 2009

Related U.S. Application Data

(60) Provisional application No. 60/958,505, filed on Jul. 6, 2007.

(51) Int. Cl.
*A63B 71/00* (2006.01)

(52) U.S. Cl. ..... 473/497

(58) Field of Classification Search ..... 473/497; 428/85

See application file for complete search history.

(56) References Cited

U.S. PATENT DOCUMENTS

| | | | | |
|---|---|---|---|---|
| 3,534,961 | A | 10/1970 | Tiley | 273/108.21 |
| 3,995,079 | A * | 11/1976 | Haas, Jr. | 428/17 |
| 4,063,729 | A | 12/1977 | Hollaway | |
| 4,230,316 | A | 10/1980 | Harper | |
| D258,903 | S | 4/1981 | Goeders | |
| 4,261,569 | A | 4/1981 | Frohlich | |
| 4,306,718 | A | 12/1981 | Goeders | |
| 4,477,075 | A | 10/1984 | Outman | |
| 4,483,073 | A | 11/1984 | Johnston | |
| 4,561,653 | A * | 12/1985 | Wright | 473/497 |
| 4,591,154 | A | 5/1986 | Santarone | |
| 4,614,339 | A | 9/1986 | Schanwald | |
| 4,657,250 | A | 4/1987 | Newland | |
| 4,666,155 | A | 5/1987 | Stille | |
| 4,749,223 | A * | 6/1988 | Goeders | 473/497 |
| 4,830,374 | A | 5/1989 | Follo | |
| 4,863,166 | A | 9/1989 | Becera | |
| 4,877,244 | A | 10/1989 | Burrows | |
| 4,925,186 | A | 5/1990 | Stevenson | |

(Continued)

FOREIGN PATENT DOCUMENTS

JP 2002294620 A 10/2002

OTHER PUBLICATIONS http://www.onlinesports.com/pages/I,CP-1236460.html?srcid=frgl&utm_source=froogle&utm_medium=cpc&utm_term=CP-1236460&cm_mmc=Froogle-__-Products-__-PPC-__-CP-1236460.*

(Continued)

*Primary Examiner* — Gene Kim
*Assistant Examiner* — Amir Klayman
(74) *Attorney, Agent, or Firm* — Lesavich High-Tech Law Group, P.C.; Stephen Lesavich

(57) ABSTRACT

An artificial pitching mound. The artificial pitching mound includes an artificial pitching rubber and artificial pitching stride component fillable with microbeads or pellets. The artificial pitching mound reduces repetitive movement injuries for baseball and softball pitchers. The artificial pitching mound also allows positive muscle memory development with a surface that duplicates the feel of natural turf during practice session and allows the athlete's muscles to react the same on both the artificial surface and natural turf.

17 Claims, 14 Drawing Sheets

U.S. PATENT DOCUMENTS 4,964,634 A 10/1990 Boyer
4,974,347 A 12/1990 Funderburk
4,978,121 A 12/1990 Larkey
4,995,607 A 2/1991 Whitfield
D315,382 S 3/1991 Ragsdale
5,009,420 A 4/1991 Martelli
5,058,889 A 10/1991 Burton
5,064,194 A 11/1991 Bixler
5,129,651 A 7/1992 Tobias, Jr.
5,188,357 A 2/1993 Barnum
5,213,323 A 5/1993 Novinsky
D338,248 S 8/1993 Beck
5,261,659 A 11/1993 Tierney
5,284,332 A 2/1994 DiTullio
5,350,172 A 9/1994 Garrett
5,368,293 A 11/1994 Waugh
5,397,392 A 3/1995 Derr
5,409,221 A 4/1995 Cohn
5,415,412 A 5/1995 McMahon
5,437,261 A 8/1995 Paulson
5,466,288 A 11/1995 Derr
5,467,977 A 11/1995 Beck
5,553,847 A 9/1996 Surrency
5,618,131 A * 4/1997 Weber ..... 404/32
5,624,112 A 4/1997 Hummel
D388,849 S 1/1998 Goeders
5,707,305 A 1/1998 Goeders
5,722,907 A 3/1998 Paulun
5,746,670 A 5/1998 Brady
5,769,745 A 6/1998 Bartoli
5,803,839 A 9/1998 Palmer
5,803,841 A 9/1998 Daskoski
5,827,140 A 10/1998 Bartoli
5,919,103 A 7/1999 Bartoli
5,967,911 A 10/1999 McAvoy
5,975,527 A 11/1999 Winchester
6,050,907 A 4/2000 Long
6,386,996 B1 5/2002 Foster
6,500,078 B1 12/2002 Williams
6,616,556 B1 9/2003 Osmudsen
6,679,795 B2 1/2004 Ouimette
6,800,339 B2 * 10/2004 Motz et al. ..... 428/17
6,805,348 B1 10/2004 Chen
6,843,739 B2 1/2005 Putnam
6,893,365 B2 5/2005 Rathbun
6,939,255 B2 9/2005 Peterson
6,945,883 B1 9/2005 Williams
6,955,616 B1 10/2005 Barth
7,006,945 B2 2/2006 Li
D520,094 S 5/2006 Hess
7,047,157 B2 5/2006 Li
7,131,918 B1 11/2006 Prince
7,143,354 B2 11/2006 Li
7,150,688 B1 12/2006 Coulbourn
7,167,809 B2 1/2007 Li
7,179,179 B2 2/2007 McDaniel
7,203,620 B2 4/2007 Li
7,244,197 B1 7/2007 Kucek
7,310,589 B2 12/2007 Li
7,344,459 B2 3/2008 Bykowsky
D567,299 S 4/2008 Hess
7,361,105 B2 * 4/2008 Goeders ..... 473/497
7,585,555 B2 9/2009 Stroppiana ..... 428/95
2001/0056001 A1 12/2001 Gallagher
2002/0052255 A1 5/2002 Trevino
2002/0183141 A1 12/2002 Ouimette
2003/0034996 A1 2/2003 Li et al.
2003/0081937 A1 5/2003 Li
2003/0130072 A1 7/2003 Barth
2003/0181269 A1 9/2003 Griffin
2003/0182620 A1 9/2003 Errico
2003/0220161 A1 11/2003 Putnam
2004/0006926 A1 1/2004 Neeley
2004/0029655 A1 2/2004 Rathbun
2004/0162169 A1 8/2004 Gallagher
2004/0178585 A1 9/2004 Cosenza
2004/0204919 A1 10/2004 Li
2004/0242352 A1 12/2004 Panus
2005/0020389 A1 1/2005 Peterson
2005/0086027 A1 4/2005 Li
2005/0096161 A1 5/2005 Gallagher
2005/0114092 A1 5/2005 Li
2005/0114907 A1 5/2005 Li
2005/0221922 A1 10/2005 Rathbun
2005/0271146 A1 12/2005 Errico
2005/0271269 A1 12/2005 Errico
2006/0010705 A1 1/2006 Dettellis
2006/0043673 A1 3/2006 Brown
2006/0059641 A1 3/2006 Fritz
2006/0100042 A1 5/2006 Bykowsky
2006/0135291 A1 6/2006 Biegen
2006/0142099 A1 6/2006 Trucks
2006/0196490 A1 9/2006 Davidson
2006/0211522 A1 9/2006 Hapanowicz
2006/0243929 A1 11/2006 McDaniel
2006/0269703 A1 11/2006 Stroppiana ..... 428/34.1
2007/0030128 A1 2/2007 Hills
2007/0111828 A1 5/2007 Goeders
2007/0117660 A1 5/2007 Roberts
2007/0142133 A1 6/2007 Kucek
2007/0148398 A1 6/2007 Stroppiana ..... 428/95
2007/0173358 A1 7/2007 Gallagher
2007/0191144 A1 8/2007 Kucek
2007/0298915 A1 12/2007 Goeders
2008/0102993 A1 5/2008 Jackson
2008/0188353 A1 8/2008 Vitolo
2008/0317978 A1 12/2008 Smit et al. ..... 428/17
2009/0011845 A1 1/2009 Weber

OTHER PUBLICATIONS www.archive.org/web/20061217184822/www.tomark.com/BaseballStore/detail.cfm?Product=1141(2 of 3)Apr. 1, 2010 5:11:40PM.*
http://www.astroturfusa.com/AboutAstroTurf.aspx.*
Tailored Turf, LLC, "*News & Events*." www.tailoredturf.us. http://tailoredturf.us/images/news_&_events/news_flash_txt_gr.jpg.
Tailored Turf, LLC, "*Practice Pitching Mounds*." www.tailoredturf.us. http://tailoredturf.us/products/practicing_mounds.asp.
Tailored Turf, LLC, "*Safer Turf Technology*." www.tailoredturf.us. http://tailoredturf.us/products/safer_turf_technology.asp.
Tailored Turf, LLC, "Detroit Testing Laboratory, Inc," Sep. 7, 2006, http://tailoredturf.us/products/turf_test_detroit_1.jpg.
"*Turf Issue: Most Area Schools Not Regularly Testing Safety of Sports Fields*," Nov. 12, 2010, by Mark Dent and Brandon George, www.dallasnews.com.
"*Surface Conditions of Highly Maintained Baseball Fields in the Northeastern United States, Part I, Non-Turfed Basepaths*," May 20, 2008, by J. T. Brosnan, and A. S. McNitt, www.plantmanagementnetwork.org.

* cited by examiner

ARTIFICIAL PITCHING SURFACE

CROSS REFERENCES TO RELATED APPLICATIONS

This Application claims priority to U.S. Provisional Application, 60/958,505, filed Jul. 6, 2007, the contents of which are incorporated by reference.

FIELD OF INVENTION

This invention relates artificial surfaces. More specifically it relates to an artificial surface suitable for contact by a human foot, and more particularly to an artificial surface suitable for contact by a human foot or other body part, the surface having durability and flexibility in order to provide comfort or reduce injury.

BACKGROUND OF THE INVENTION

An artificial surface suitable for contact by a human foot or other body part tends to lack the flexibility of a natural turf or other desired surface. Any activity or occupation, which requires long periods of standing or moving on foot, is enhanced by a reasonable flexibility of the surface. This reasonable flexibility can add to a person's reasonable endurance and minimize injury.

An artificial surface usually lacks the flexibility of a grass covered surface. This lack of flexibility can cause injury even if the contact with the surface is merely walking or standing.

Artificial surfaces, commonly known as artificial turf, are routinely used for playing surfaces on baseball field, a football field, or another playing surface. One difficulty in this artificial turf occurs because of the surface on which the turf must be mounted. This surface lacks the resiliency of grass and can many times cause injury to the players.

Typical injuries caused by an artificial surface occur to a knee or to a toe. There is even a vernacularly named disease call "turf toe", which refers to a big toe injury caused by artificial turf. What is desired is the provision of a surface with the required durability, while adding thereto the necessary flexibility for the surface in order to avoid the damage caused to knees or toes, or to an athlete in general.

Compensating for the lack of water by an artificial turf surface is difficult. Each artificial surface is different. Differences include variances in the length and the terrain.

While an artificial surface does not soak, or absorb water, as a grass surface does, it is sometimes difficult to remove the water from the surface. Pushing the water off of the surface is time consuming and difficult. Clearly, a simpler method of removing water from the surface is desired.

It is highly desirable to combine safety, flexibility and durability of a grass field with the cleaning and drying ability and ease of maintenance of artificial turf. If these two factors can be combined, the advantages of artificial turf become very clear.

Furthermore, it is also desirable to provide the comfort underfoot for a person who must stand for a long period. Standing on a hard surface can induce fatigue and injuries. This fatigue can interfere with that person doing the desired work. Reduction of fatigue and injuries creates a great advantage.

A surface that requires repeated impact, a long period of standing, a flexible, durable, easily cleaned surface is also highly desirable. An artificial surface can provide fatigue reduction for a person with the surface being easily cleaned and having improved durability.

Baseball and softball pitchers of all ages from, developmental leagues (park districts, etc) little league, pony league, high school, college, professional including major and minor leagues are subject to injuries from landing incorrectly on a pictures mound. The pitcher's lead foot through the pitching stride makes repetitive impacts on hard dirt or other hard surfaces. A pitcher's lead foot often slips increasing the chance of groin pulls or ankle, knee or hip injuries or shin splints. A pitcher's back foot makes repetitive movements off the pitching rubber also causing injuries. Many hours of practice on real pitching mounds construct of dirt and stand often leads to injures and aggravates such injuries.

This it is desirable to provide an artificial surface that solved some of the problems described above.

SUMMARY OF THE INVENTION

In accordance with preferred embodiments of the invention, some of the problems associated with artificial surfaces are overcome An artificial pitching mound is presented. The artificial pitching mound includes an artificial pitching rubber and artificial pitching stride component fillable with microbeads or pellets. The artificial pitching mound also allows positive muscle memory development with a surface that duplicates the feel of natural turf during practice session and allows the athlete's muscles to react the same on both the artificial surface and natural turf.

The foregoing and other features and advantages of preferred embodiments of the present invention will be more readily apparent from the following detailed description. The detailed description proceeds with references to the accompanying drawings.

BRIEF DESCRIPTION OF THE DRAWINGS

Preferred embodiments of the present invention are described with reference to the following drawings, wherein.

DETAILED DESCRIPTION OF PREFERRED EMBODIMENTS

Figure 1:
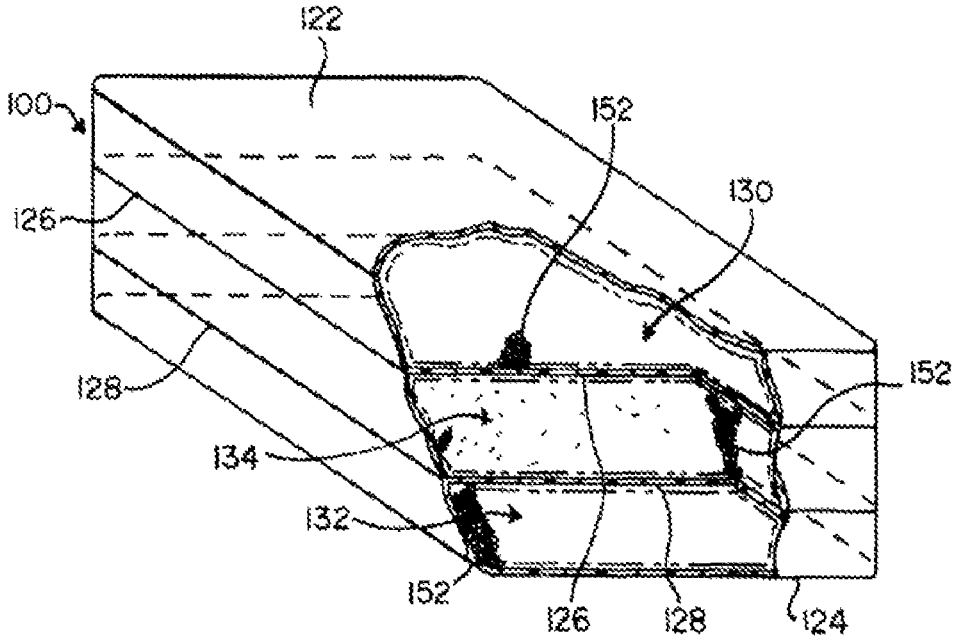
FIG. 1 is block diagram illustrating a perspective partially cutaway view of a plural, compartment-containing device having filler therein.

A FIG. 1 is block diagram illustrating a perspective partially cutaway view of a plural, compartment-containing device having filler therein. A device having at least one compartment containing a filler can have the filler placed in a fixed position by the application of a vacuum to the filler-containing compartment. The vacuum supports the filler in a position, while providing flexibility and durability for the outer surface of the compartment.

The contour of the surface of this device can be changed by positioning the filler inside the compartment. Then by application of the vacuum to the compartment, the filler becomes secured in a position to maintain the contour of the surface. The surface can then conform to a desired use for the device. This device can then retain a given surface or have that surface changed when desired.

Very desirably, an advantageous use for this device is an artificial turf having a changeable surface. The artificial turf is secured to a bottom sheet at the edges thereof to form the compartment. An opening to the compartment is achieved by a valve suitable for having a vacuum applied thereto.

Into the compartment is placed a filler. After the vacuum is applied to valve, the filler provides the outer surface with a firm but flexible surface. This feature serves to reduce fatigue.

The contour of the surface of this turf can be changed at will to conform to a desired use. This turf can then retain a given surface or be changed when desired.

Plural small compartments can be assembled and placed in a frame. The surface may then be covered as surface. Such a structure, like any structure disclosed herein can be used in the place of employment, any recreational area or other area as desired.

This artificial turf can be used for an in-home putting green for golf. It can also be used for miniature golf and indoor golf. Because of its changeable contour, this turf may also be used to replace artificial turf on football, baseball and soccer fields along with tennis courts, and other athletic fields. It can even be used on golf courses where water use is restricted.

This turf is made from two pieces of a sheet material welded together along the edge of the sheet and filled with pellets of plastic beads or a similar particle. It makes a bag-type container, like a giant, flat bean bag. The size can be made to anyone's specifications with a surface area of up one square mile. A larger surface is usually assembled on site.

Smaller filler container compartments can be framed and positioned as desired. These smaller containers can be assembled on site or off site. If off site is desired, the smaller compartments are easily transported.

With the particles in the compartment, usually in the form of a bag or a container, a desired flexibility is achieved. This flexibility greatly reduces the injuries that can and do result from playing on the standard artificial turf.

This structure can also be used as a floor surface in a factory or other place of business, where standing or being on foot is required. This compartmented structure provides comfort for the worker.

In one embodiment, the surface is made firm by applying a vacuum. The pressure can be adjusted from a positive pressure to about twenty-four and twenty-nine inches of mercury. The greater the vacuum pressure, the firmer the surface. Therefore, the user of the surface can adjust the firmness of the surface to the required parameters use. When used outside, the vacuum can be reversed to inflate the turf. The turf then assumes a shape which forces the water from a rain to be quickly removed.

The filler may be any suitable particulate filler or bead filler. Preferably, the filler has a diameter of up to about one centimeter. More preferably, the filler has a diameter of about 0.01 to about 0.9 centimeter. Most preferably, the filler has a diameter of about 0.05 to about 0.8 centimeter.

The sheet used herein may be any suitable substantially air impermeable, edge bondable sheet. A rubber sheet is useful. Also a synthetic resin sheet or a plastic sheet is usable.

Considering now FIG. 1, a perspective partially cutaway view of a plural, compartment-containing device 100 having filler 152 therein includes a first outer sheet 122 and a second outer sheet 124. Therebetween is a first interior sheet 126 and a second interior sheet 128. This structure may be used for an athletic surface or a factory floor.

First outer sheet 122 is oppositely disposed from second outer sheet 124, with first interior sheet 126 and a second interior sheet 128 therebetween. All sheets are edge bonded. First outer sheet 122 is adjacent to first interior sheet 126. Second outer sheet 124 is adjacent to second interior sheet 128. First interior sheet 126 is adjacent to second interior sheet 128.

First outer sheet 122 combines with first interior sheet 126 to form first outer pocket 130. Second outer sheet 124 combines with second interior sheet 128 to form second outer pocket 132. First interior sheet 126 combines with second interior sheet 128 to form inner outer pocket 134.

Figure 2:
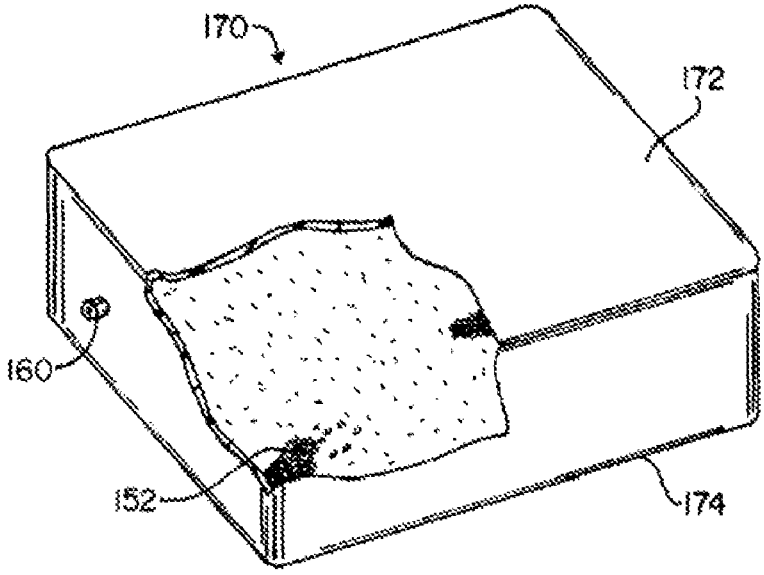
FIG. 2 is block diagram illustrating a perspective partially cutaway view of a single compartment-containing device having filler therein.

With FIG. 2 is block diagram illustrating a perspective partially cutaway view of a single compartment filler-containing device 170 having filler 152 therein. First flexible sheet 172 and second flexible sheet 174 are edge bonded with vacuum valve 160 access for attaching pump 150 thereto. This structure may also be used for an athletic surface or a factory floor.

Figure 3:
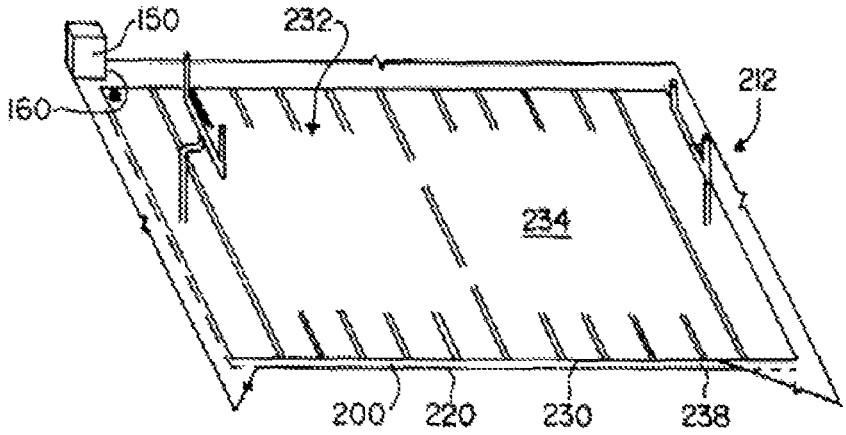
FIG. 3 is block diagram illustrating a perspective, partially cutaway view of an artificial turf surface in the shape of a football field.

Referring now to FIG. 3, the artificial turf surface container 200 is depicted. The turf surface container 200 includes a bottom sheet 220 secured to a top sheet 230. The bottom sheet 220 basically has two plain sides. The securing of the bottom sheet 220 to the top sheet 230 may be achieved in any suitable airtight fashion. A securing mechanism is exemplified by sewing, welding, glue, or other suitable mechanism. The artificial turf surface 200 in the shape of a football field 212.

The turf top sheet 230 and the bottom sheet 220 are sufficiently durable material to stand the pounding that any athletic event, such as, in this particular case, a football field 212, can administer to the turf surface.

The top sheet 230 includes a turf surface 232 and a flat surface 234. Flat surface 234 appears on the interior space 238 of the artificial turf surface container 200. The grasslike or artificial turf surface 232 appears on the top thereof and is marked appropriately for a football field 212.

Within the space 238 created between the two sheets, is inserted a durable flexible material such as glass beads 152. The two sheets 220 and 230 are connected to a vacuum pump 150. Pump 150 can withdraw or insert air in between the sheets 220 and 230 to be contained in space 238. As the air is withdrawn, the glass beads 152 between the sheets provide for flexibility of the sheet. Other than glass beads can also be used to practice the invention.

The vacuum valve 160 permits the pump 150 to communicate with interior 238. Thus, the pump 150 can withdraw air from the space 238.

Figure 4:
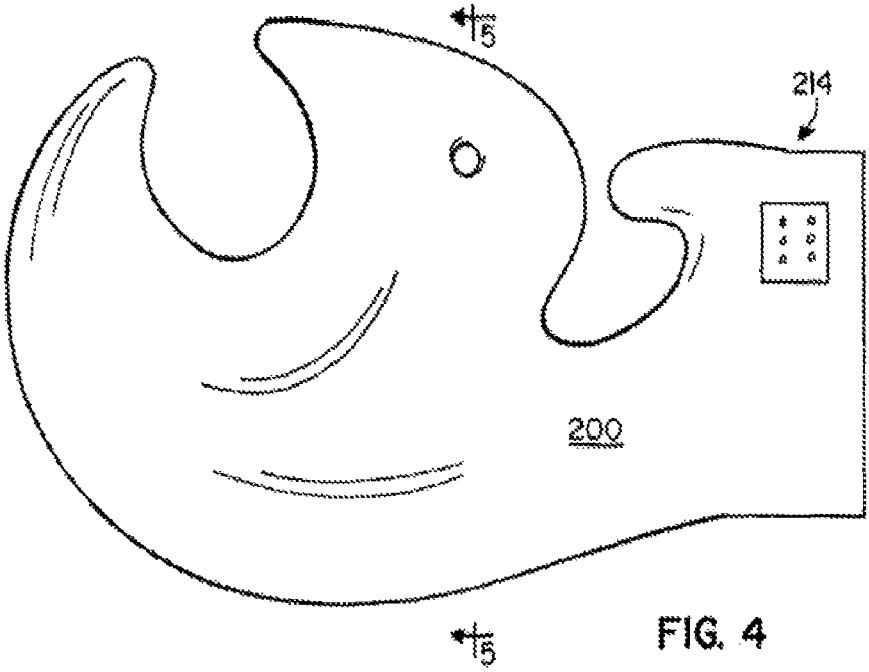
FIG. 4 is block diagram illustrating a top plan view of an artificial turf surface in the shape of a hole for miniature golf.
Figure 5:
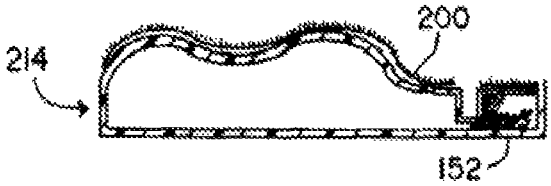
FIG. 5 is block diagram illustrating a side, cross-sectional view of artificial turf surface in the shape of a hole for miniature golf based on FIG. 1.

Referring now to FIG. 4, where the shape of a hole for miniature golf 214 is seen, it is possible to position the glass beads 152 there between the sheets. As the glass beads 152 are positioned, and the vacuum is drawn by pump 150, the glass beads 152 are held into the appropriate position to achieve the desired results of the shape of the hole for miniature golf 214.

Figure 6:
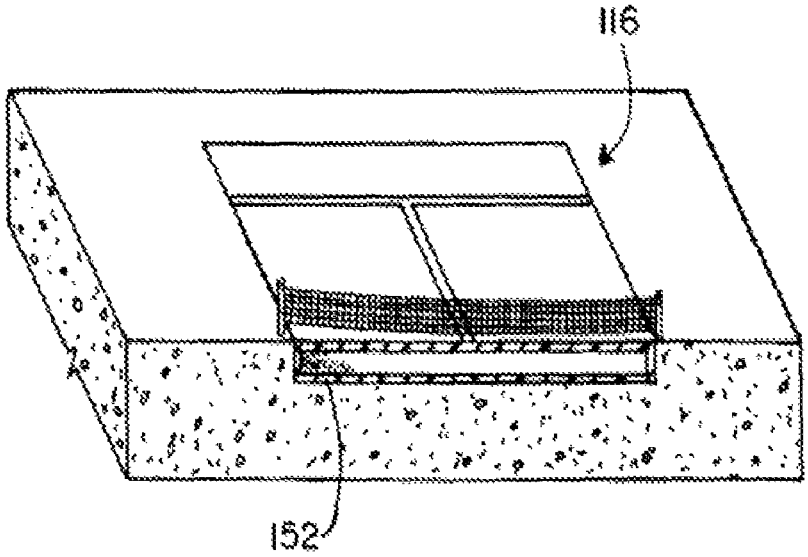
FIG. 6 is block diagram illustrating a perspective partially cutaway view of artificial turf surface in the shape of a tennis court.

Referring now to FIG. 6, the artificial turf surface for shape of a tennis court 216 is similar to that of a football filed 212 but varies in size, shape and markings. The tennis court 216 uses the glass beads 152 to create a flat grasslike surface and provide for the flexibility and durability of artificial turf.

Figure 7:
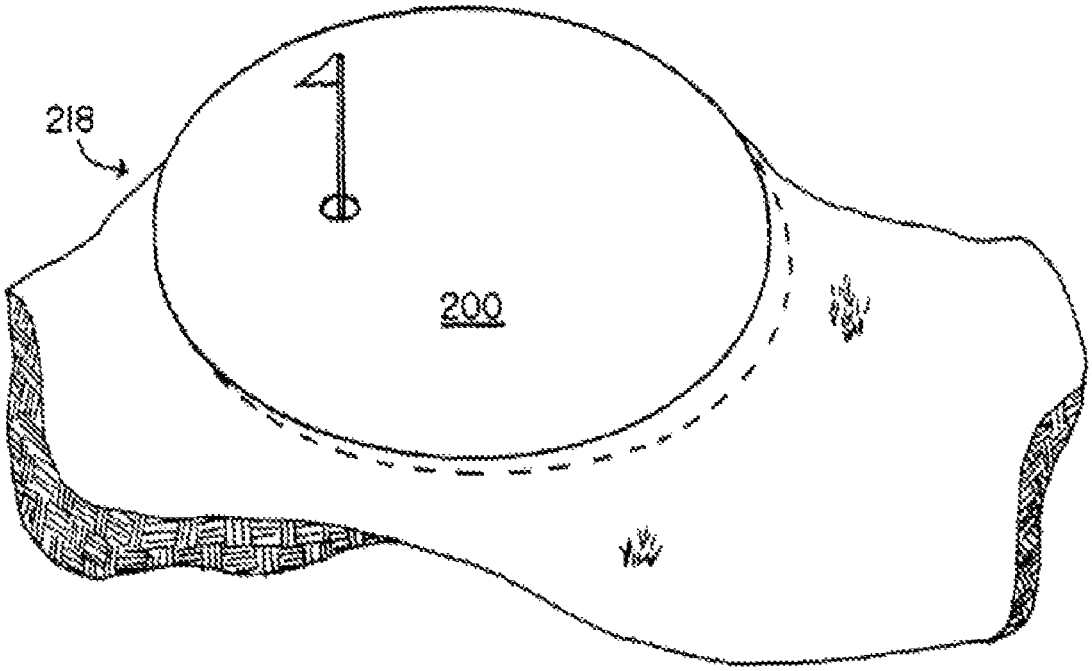
FIG. 7 is block diagram illustrating a perspective partially cutaway view of artificial turf surface in the shape of a hole for standard golf.

In FIG. 7, the artificial turf surface is block diagram illustrating a standard golf course 218 which is basically an enlargement of FIG. 4. This artificial turf surface 200 can be made through a plurality of pockets and joining to achieve the desired result. However, with the vacuum aspect of the beads, it is possible to make two big sheets of sufficient size and shape for the golf course. In this fashion, as the beads are shaped, the vacuum can be drawn and the desired results are obtained.

Figure 8:
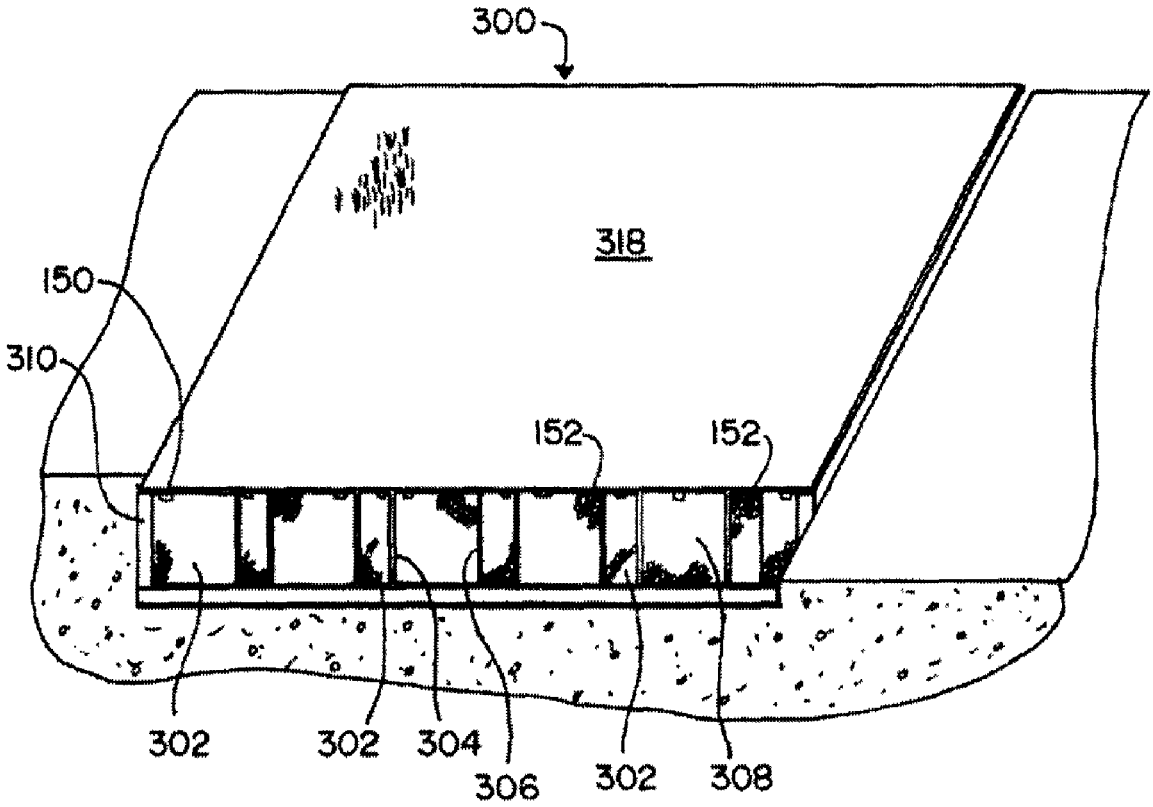
FIG. 8 is block diagram illustrating a perspective partially cutaway view of sheet turf surface supported by a plurality of small filled compartments.

FIG. 8 is block diagram illustrating a perspective partially cutaway view of sheet turf surface 300 supported by a plurality of small filled compartments 302. Each filled compartment 302 has a first small sheet 304 edge secured to a second small sheet 306 with a vacuum valve 150 granting access to small interior 308 for filler 152. A plurality of small compartments 302 are mounted in frame 310, which in turn is covered with turf sheet 300. The vacuum applied to each filled compartment 302 determines the flexibility of the surface 318.

Non-Vacuum Artificial Surface

Figure 9:
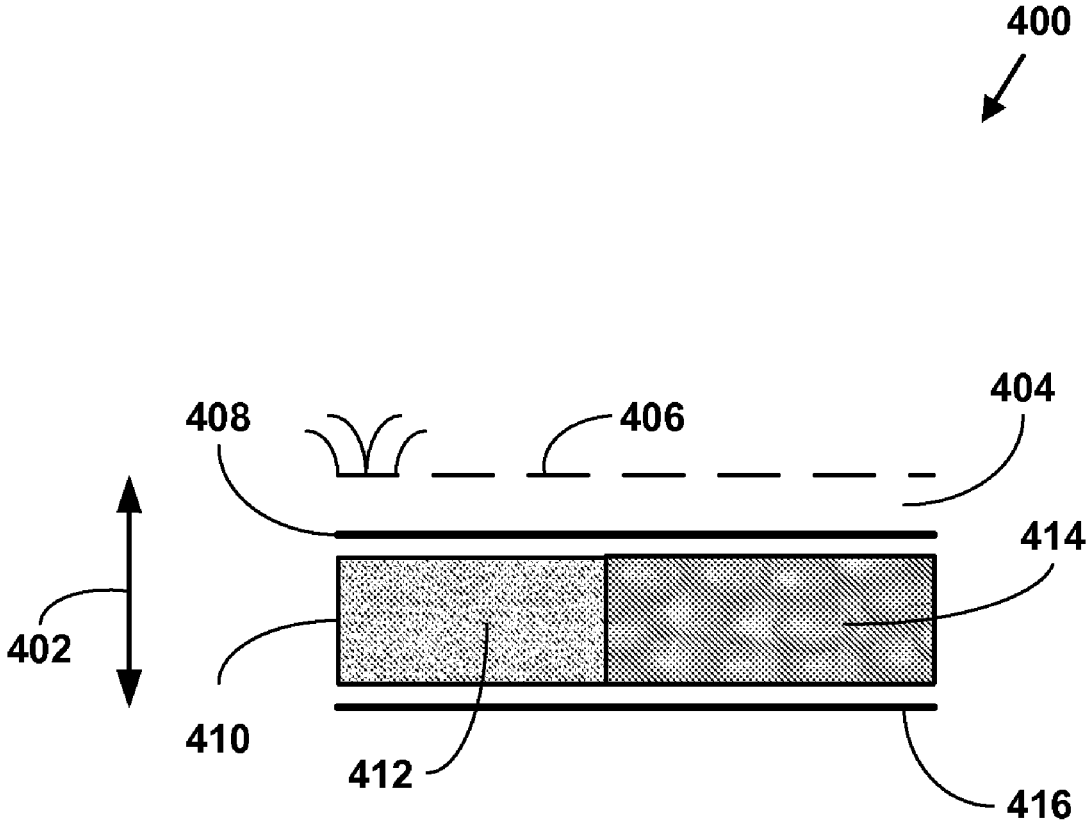
FIG. 9 is a block diagram illustrating a side view of an exemplary artificial surface with plural layers including plural different fillers for the layers.

FIG. 9 is a block diagram illustrating 400 a side view of an exemplary artificial surface 402 with plural layers including plural different fillers for the layers. The artificial surface 402 does not require the application of a vacuum to maintain a shape or resistance of the artificial surface 402. The contour of the surface is changed by pre-selecting different types and different depths of filler in the plural compartments. The different types of filler become secured in a position to maintain a desired contour and resistance of the surface.

In one embodiment, the artificial surface 402 includes a first layer comprising a turf sheet 404. In one embodiment, the turf sheet 404 includes a first permeable layer 406 that is the surface that a user interacts with. In this embodiment, the first permeable layer 406 absorbs and drains water. The turf sheet 404 has low heat absorption properties and efficiently dissipates heat that is absorbed so heat does not build up on the surface of the turf sheet and to make it hot or uncomfortable to walk on or play on.

In one embodiment, the first permeable layer 406 is a composite material. In another embodiment, the first permeable layer 406 is a flexible masonry lining used typically used in association with laying brick or others masonry. In another embodiment, the first permeable layer 406 is a specialized polypropylene. For example, the specialized polyethylene is a soft polyethylene two inch synthetic fiber that is Ultra Violet (UV) energy protected that has been tufted on a porous backing and resembles real grass. The fibers are water resistant the porous backing insures the proper drainage.

As is known in the art UV energy is radiant energy within the wavelength range of 0.001 to 0.38 microns and is part of the spectrum produced by sunlight. UV rays can cause chemical changes in rubbery materials and polymers.

In one embodiment, the turf sheet also includes a second impermeable layer 408 that allows water to drain laterally. In another embodiment, the turf sheet 404 only includes a first permeable layer 406. In such an embodiment, the first permeable layer 406 allows water to drain down directly into a second layer 410

Below the first layer 404 is a second layer 410 comprising a plural separate compartments 412, 414 (two of which are illustrated) including plural microbeads. In one embodiment, the plural microbeads comprise silicone, dacron, polystyrene, polypropylene, prolene, gortex, other plastic, rubber, composite materials and other natural and synthetic materials. In another embodiment, the second layer 410 comprises plural compartments including a fibrous material of varying thicknesses. In such an embodiment, the fibrous material includes a fiberglass, fiberous composite material, rubber, or other fibrous material that can be compressed and springs back. However, the present invention is not limited to this embodiment and other types of microbeads and other types of materials can also be used for the second layer 410.

As is known in the art, microbeads have been used for various devices bean-bag chairs, pillows, toys and other devices. When microbeads are used to fill an apparatus, the apparatus is light weight, yet firm, and retains the shape of the container.

A preferred range of microbead sizes is from approximately 1 millimeter (mm) to approximately 5 mm in diameter. However, the present invention is not limited such an embodiment and other sizes, both larger and smaller of microbeads can also be used to practice the invention.

In one embodiment, the plural separate compartments include plural different sizes and shapes of microbeads. The different types of microbeads with the different sizes and shapes provide plural different types of resistance. How firm a surface is including microbeads is dependant on the size and shape of the microbeads and as well as how the microbeads move in association with and make contact with other microbeads in a compartment. For example, circular-shaped microbeads have a different feel and resistance than oval-shaped or trapezoidal shaped microbeads. Larger microbeads interact with each other in different ways than smaller microbeads. In another embodiment, the plural separate compartments include the same size and shape microbeads. In another embodiment, the plural separate compartments include the same size but different shape microbeads. In another embodiment, the plural separate compartments include the same shape but different size microbeads. However, the present invention is not limited to such embodiments and other embodiments and other combinations thereof can be used to practice the invention.

FIG. 9. illustrates a first compartment 412 including small microbeads. Such small microbeads may have a resistance like that of a natural sand or sandy material. FIG. 9 also illustrates a second compartment 414 including larger microbeads. Such larger microbeads have a different, greater resistance like that of a natural dirt or dirt like material.

In one embodiment, the plural compartments 412, 414 in the second layer 410 are filled with pre-determined depths to vary the resistance, feel and contour of the artificial surface 402.

For example, the first compartment 412 with the small microbeads may be filled to an exemplary depth of one inch to provide a sandy material like resistance while the second compartment 414 may be filled with larger microbeads of an exemplary depth of four inches to provide a greater resistance dirt like material. However, the present invention is not limited to these embodiments, and other depths and other combinations can also be used to practice the invention.

In one embodiment the plural compartments are separate compartments separated by formal dividers. In another embodiment, the plural compartments include microbeads of pre-determined selected sizes and shapes contained within individual containing materials such as a mesh material or a bag-like membrane material. In one embodiment the separate compartments are plural individual and separate compartments that are placed in adjacent and in direct contact with each other. In such an embodiment, various types and depths of microbeads can be selected in virtually in combination to form a desired artificial surface. However, the present invention is not limited to this embodiment and other embodiments can be used to practice the invention.

In one embodiment, artificial surface 402 further includes a third layer 416. In one embodiment, the third layer 416 is permeable to water and allows water to drain directly onto the underlying surface to which the artificial surface 402 has been placed upon. In another embodiment, the third layer 416 is impermeable to water and allows water to be drained laterally off the artificial surface 402. In one embodiment, the third layer 416 comprises a polypropylene plastic, or other plastic.

Figure 10:
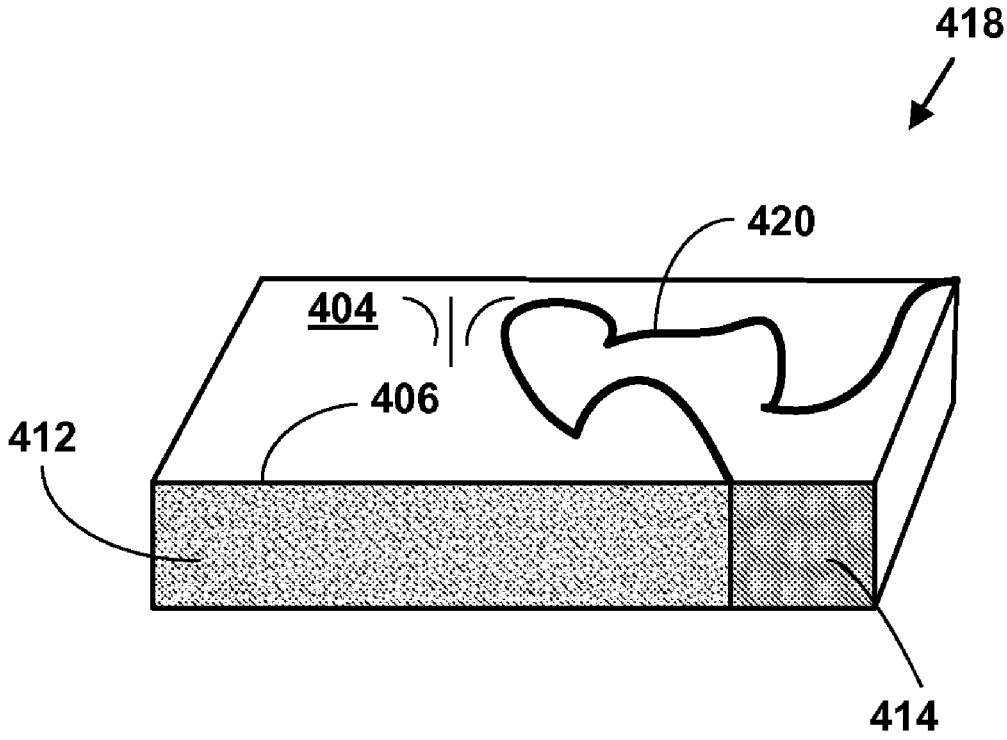
FIG. 10 is a block diagram illustrating a perspective view of a first artificial surface.

FIG. 10 is a block diagram illustrating a perspective view 418 of artificial surface with first compartment 412 and second compartment 414 with different sized microbeads. Such an embodiment may be used for a golf course and other landscaping features. In this figure, the first compartment 412 and the second compartment 414 are illustrated as irregular shapes with an irregular contour 420. Have, the present invention is not limited to such compartment shapes and other shapes and other combinations can also be used to practice the invention.

Figure 11:
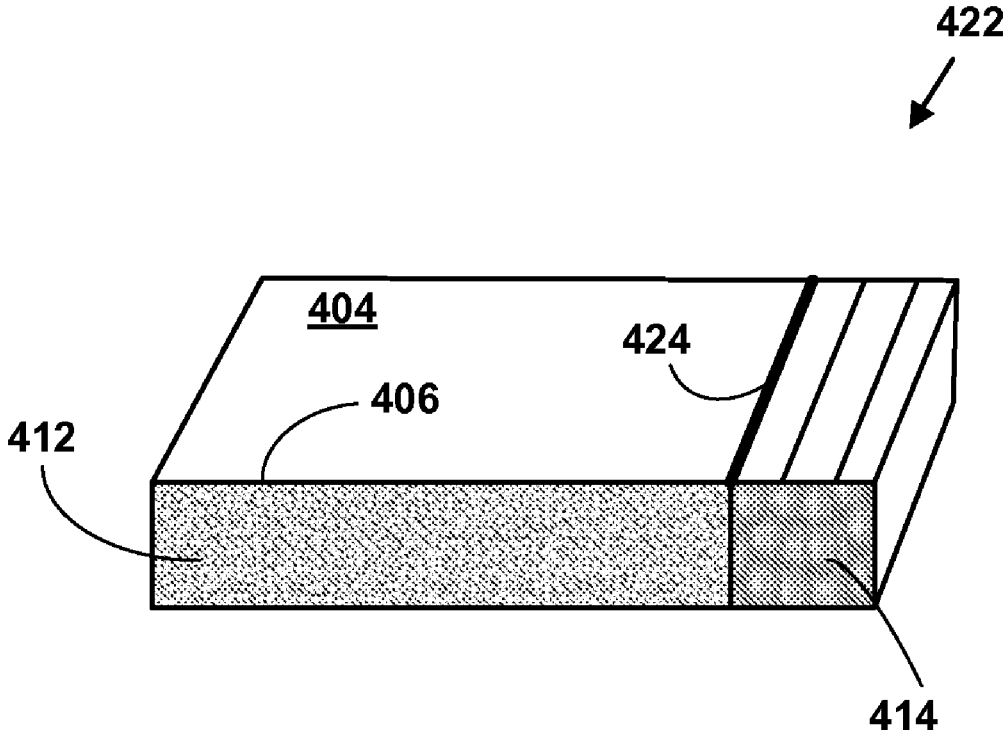
FIG. 11 is a block diagram illustrating a perspective view of a second artificial surface.

FIG. 11 is a block diagram illustrating a perspective view 422 of artificial surface with first compartment 412 and second compartment 414 with different sized microbeads. In this figure, the first compartment 412 and the second compartment 414 are illustrated as regular shapes with a regular contour 424. Such an embodiment may be used for a landscape feature such as a pitching mound, etc.

Artificial Pitching Mound

A regulation pitcher's mound is about 18 feet in diameter. The pitcher's plate (or pitching rubber as it is commonly called) is about 18 includes behind dead center of the mound. The slope from a pitching rubber begins six inches in front of the rubber and slopes toward home plate one inch for every one foot. The rubber rests six inches inside the front edge of a level area five feet wide and about 34 inches deep and is not more than about ten inches higher than the playing field. The pitcher must keep the back foot on the pitching rubber when throwing a pitch.

Baseball and softball pitchers of all ages from, developmental leagues (park districts, etc) little league, pony league, high school, college, professional including major and minor leagues are subject to injuries from landing incorrectly on a pictures mound. The pitcher's lead foot through the pitching stride makes repetitive impacts on hard dirt or other hard surfaces. A pitcher's lead foot often slips increasing the chance of groin pulls or ankle, knee or hip injuries or shin splints. A pitcher's back foot makes repetitive movements off the pitching rubber also causing injuries.

Figure 12:
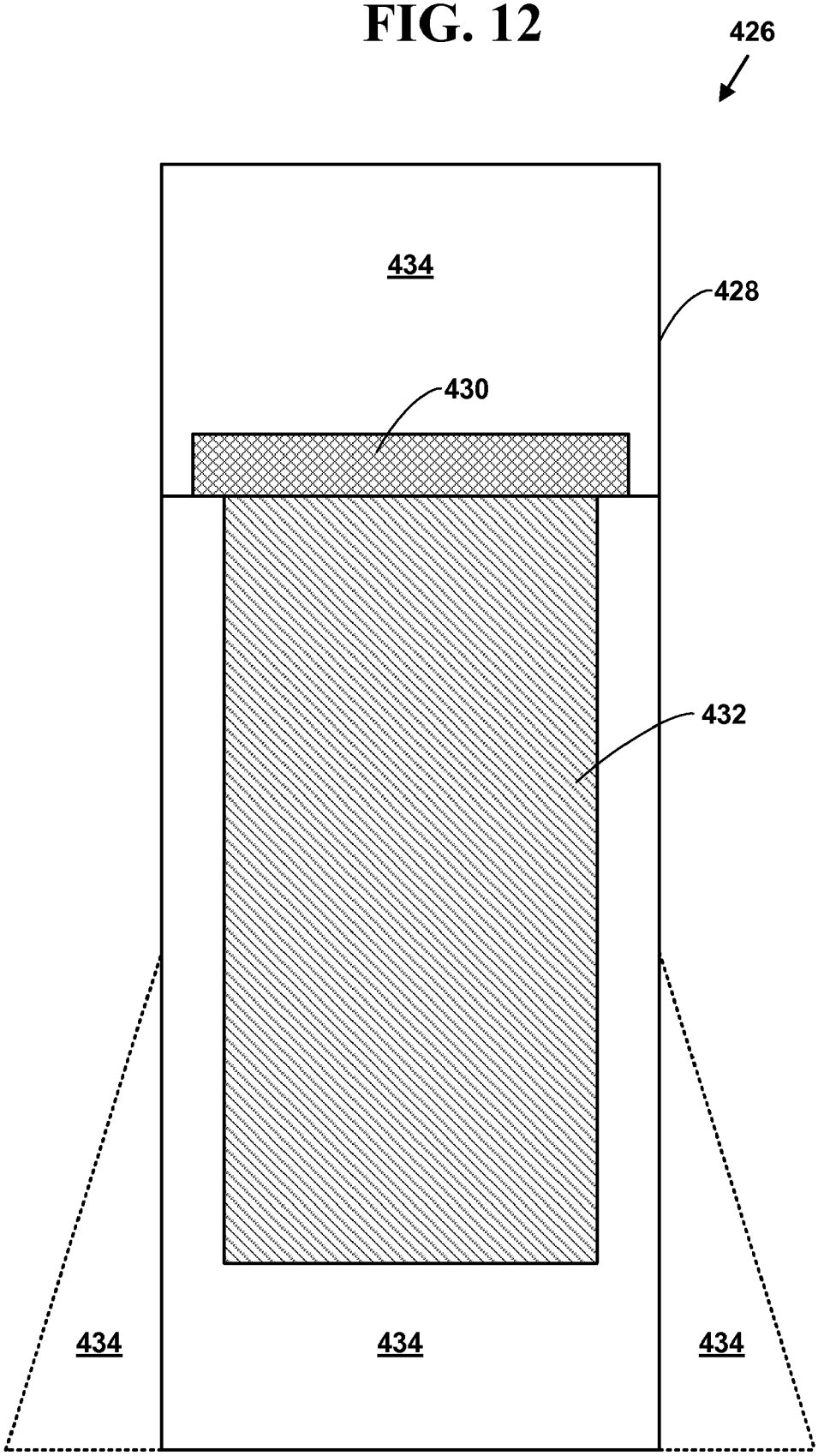
FIG. 12 is a block diagram of plan view of an artificial pitching mound apparatus.

FIG. 12 is a block diagram 426 of a plan an artificial pitching mound apparatus 428. The artificial pitching mound apparatus 428 includes an artificial pitching rubber 430, a pitching stride component 432 and an artificial mound component 434.

Figure 13:
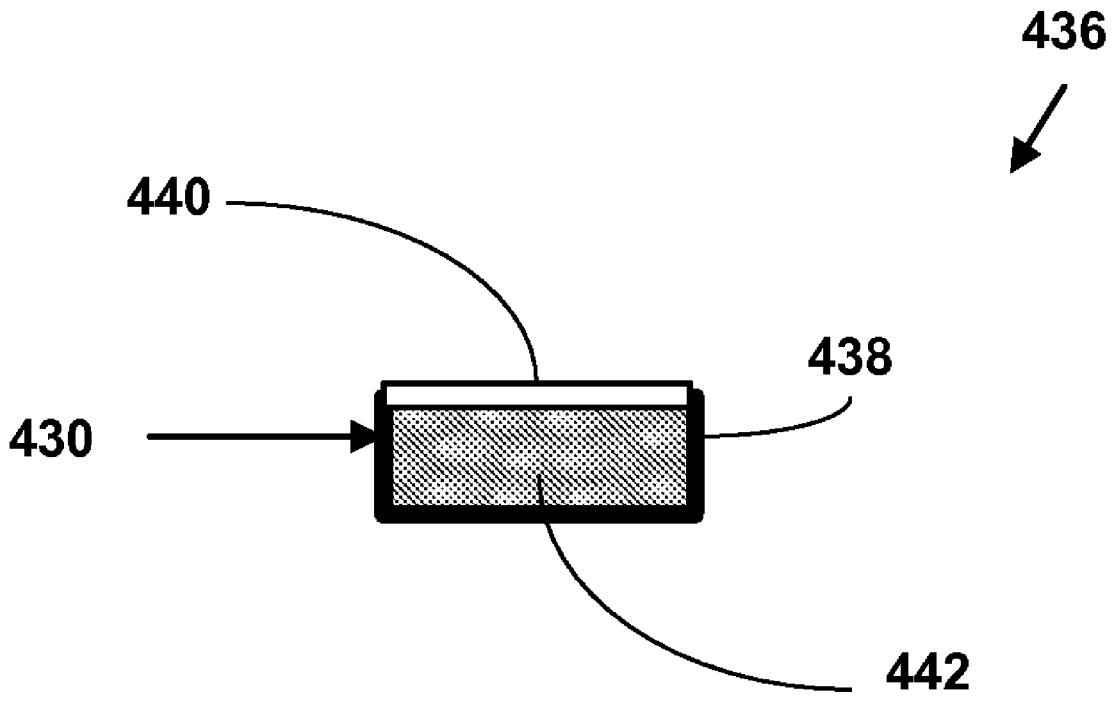
FIG. 13 is a block diagram illustrating a side view of an artificial pitching rubber.

FIG. 13 is a block diagram illustrating a side view 436 of the artificial pitching rubber 430. The artificial pitching rubber 430 comprises a first fillable component 438. The first fillable component includes a cover layer 440. The cover layer 440 is where a pitcher places his or her foot.

In one embodiment, the first fillable component 438 and the cover layer 440 comprise silicone, dacron, polystyrene, polypropylene, prolene, gortex, other plastic, rubber, composite materials or other natural or synthetic materials.

The first fillable component 438 is filled with microbeads 442 or pellets of a pre-determined size and shape and depth. FIG. 13 illustrates the first fillable component 438 completely filed with microbeads 442. In another embodiment, the first fillable component 438 is not completely filed with microbeads 442. The first fillable component 438 may be filled with microbeads or pellets of a same size and shape or varying sizes and vary shapes or varying shapes and a same size or varying sizes and a same shape. The pellets have sizes and surface characteristics different from those of microbeads and are produced with a different manufacturing process than those used for manufacturing microbeads. The interaction between the surfaces of the microbeads or pellets determines a feel and resistance of the pitching rubber 430.

The microbeads 442 in the first fillable component 438 make the pitching rubber 430 flexible yet firm and similar to the look and feel of an actual pitching rubber. The microbeads 442 or pellets help prevent or reduce repetitive injuries that occur with an actual pitching rubber made of a single piece of hard rubber, wood, plastic and fastened to an actual pitching mound.

A preferred range of microbead 442 and 452 (FIG. 14) sizes is from approximately 1 millimeter (mm) to approximately 5 mm in diameter. However, the present invention is not limited such an embodiment and other sizes, both larger and smaller of microbeads can also be used to practice the invention.

In one embodiment, the plural separate compartments include plural different sizes and shapes of microbeads. The different types of microbeads with the different sizes and shapes provide plural different types of resistance. How firm a surface is including microbeads is dependant on the size and shape of the microbeads and well as how the microbeads move in association with and make contact with other microbeads in a compartment. For example, circular-shaped microbeads have a different feel and resistance than oval-shaped or trapezoidal shaped microbeads.

In one embodiment, the first fillable component 438 includes microbeads of pre-determined selected sizes and shapes contained within individual containing materials such as a mesh material or a bag-like membrane material. However, the present invention is not limited to this embodiment and other embodiments can also be used to practice the invention. The first fillable component 438 does not require a mesh material or a bag-like membrane to contain the microbeads 442.

Figure 14:
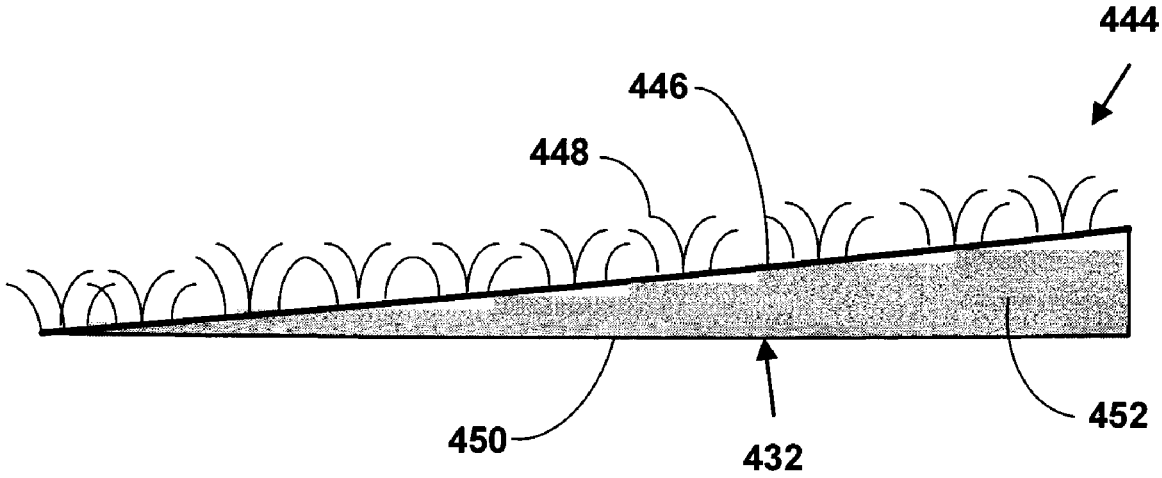
FIG. 14 is a block diagram illustrating side view of the pitching stride component.

Larger microbeads (e.g., 442, FIG. 13) interact with each other in different ways than smaller microbeads (e.g., 452, FIG. 14). In another embodiment, the plural separate compartments include the same size and shape microbeads. In another embodiment, the plural separate compartments include the same size but different shape microbeads. In another embodiment, the plural separate compartments include the same shape but different size microbeads. However, the present invention is not limited to such embodiments and other embodiments and other combinations thereof can be used to practice the invention.

In one embodiment, the first fillable component 438 includes plural individual fillable components separated by plural dividers. The plural dividers include horizontal, vertical, angular or other combinations thereof. In such an exemplary embodiment, the individual fillable components are filled with microbeads or pellets of a pre-determined size, shape and depth. The size shape and depth of the microbeads can be the same or different in each individual fillable component.

In one specific exemplary embodiment, the artificial pitching rubber 430 components, the first fillable component 438 and the cover layer 440 are made of heavy-duty molded polyurethane for durability and long service. However, the present invention is not limited to this one specific exemplary embodiment and other materials can be used for the pitching rubber 430 components.

In one specific exemplary embodiment, the artificial pitching rubber 430 is six inches wide, four inches deep and forty-two inches long. However, the present invention is not limited to these exemplary embodiments and other embodiments of other sizes can also be used to practice the invention.

The pitching stride component 432 includes safer surface for landing a pitching stride on a surface that absorbs impact better than natural turf in a manner safer for the athlete. The athlete's lead foot through the stride does not slip as much on the pitching stride component 432 reducing the chance of groin pulls or ankle, knee or hip injuries or shin splints. The pitch stride surface 432 allows positive muscle memory development with a surface that duplicates the feel of natural turf during practice session and allows the athlete's muscles to react the same on both the artificial surface and natural turf.

FIG. 14 is a block diagram illustrating side view 444 of the pitching stride component 432. The pitching stride component includes a top surface layer 446 of pitching comprising a specialized polypropylene or nylon artificial grass with plural groups of fibers 448 comprising for example, a soft polyethylene or nylon two inch synthetic fiber that is UV protected that has been tufted on a porous backing and resembles real grass. The grass fibers are water resistant the porous backing insures the proper drainage.

In one specific exemplary embodiment, the pitching stride component 432 comprises a tapered second fillable component 450 that is about nine inches deep at a first end and tapers to less than one inch at a second end. In one exemplary embodiment, the pitching stride component 432 includes a width of about thirty-six inches and a length of about seventy-four inches.

In one embodiment, the tapered second fillable component 450 is made of heavy-duty molded polyurethane for durability and long service. However, the present invention is not limited to this embodiment and other materials can be used for the tapered second fillable component.

In one embodiment, the tapered second fillable component 450 includes microbeads of pre-determined selected sizes and shapes contained within individual containing materials such as a mesh material or a bag-like membrane material. However, the present invention is not limited to this embodiment and other embodiments can also be used to practice the invention. The tapered second fillable component 450 does not require a mesh material or a bag-like membrane to contain the microbeads 452.

In one embodiment, the second fillable component 450 is completely filled with microbeads 452 or pellets. In another embodiment, the second fillable component is not completely filled with microbeads 452 or pellets as is illustrated in FIG. 14.

In one exemplary embodiment, the pitching stride component 432 includes a tapered second fillable component 450 that includes plural individual fillable components separated by plural divider components. In such an embodiment, the plural individual fillable components are filled with microbeads or pellets that are a same size and shape or are varying sizes and shapes.

In another exemplary embodiment, the comprises a tapered second fillable component 450 without individual fillable components may also be filed with microbeads or pellets of a same size and shape or microbeads and pellets of varying sizes and shapes. Interactions between microbeads of a same size and shape and mixes varying sizes and shapes provide different resistances and feels to the pitching stride component 432. However, the present invention is not limited to these exemplary embodiments and other embodiments of other sizes can also be used to practice the invention.

The microbeads or pellets are selected with pre-determined size and shape specifically for the pitching stride component 432. In one embodiment, the microbeads or pellets are of a different size and shape 452 than those microbeads 442 used for the pitching rubber 430. For example, in one specific exemplary embodiment, the pitching rubber 430 is filled with a larger microbead 442 and the pitching stride component is filled with a smaller microbead 452. In another embodiment, the microbeads and pellets the same size and shape as those used for the pitching rubber 430.

For example, the larger microbeads 442 are used to provide a resistance for a natural dirt like material while the smaller microbeads 452 provide a greater resistance similar to a natural sandy like material. However, the present invention is not limited to these embodiments, and other depths and other combinations can also be used to practice the invention.

Each pitcher can shape and reshape their own desired "dig-out" or depression configuration in front of the pitching rubber 430 on the pitching stride component 432 by re-adjusting the microbeads or pellets into a desired depression configuration (e.g., with a foot or hand, utensil, etc.). The desired configuration maintains its desired size and shape as a result of the characteristics of the microbeads or pellets and interactions between surfaces of the microbeads or pellets.

The artificial mound component 434 includes the artificial pitching rubber 430 at first end in contact with the artificial pitching surface 432, which slopes downward to a second end of artificial mound component 434. The artificial mound component 434 supports the artificial pitching rubber 430 and the artificial pitching stride component 432 and exceeds a width and length of both components 430, 432 by a pre-determined amount to provide stability and support. The artificial mound component 434 may also include optional plural stability components 435 (FIG. 12) to provide additional stability support. The optional plural stability components 434 includes various sizes and shapes (e.g., triangles, squares, trapezoids, etc.). The apparatus 428 can be used with or without the plural stability components 434.

The apparatus 428 will not rust, requires no welds and includes a no skid bottom that secures the practice mound on most any surface. The apparatus 428 includes a regulation pitching mound that is ten inches high, sloped one inch per foot to the front that feels like a natural pitching mound. However, the apparatus 428 helps reduce and/or prevent repetitive injuries for athletes.

Figure 15:
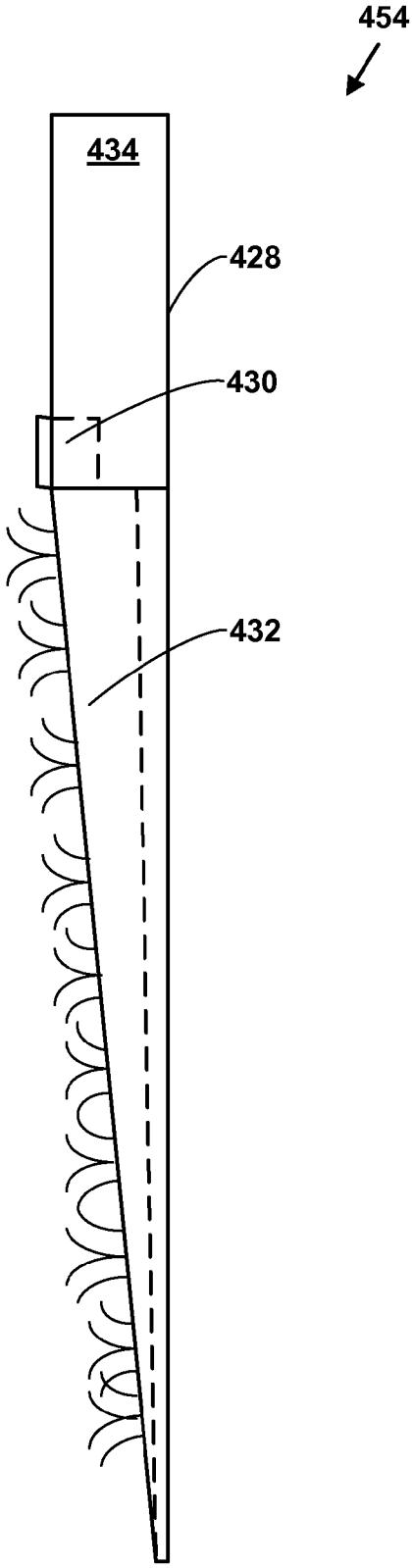
FIG. 15 is block diagram of a side view of the artificial pitching mound apparatus.

FIG. 15 is block diagram of a side view 454 of the artificial pitching mound apparatus 428.

Figure 16A:
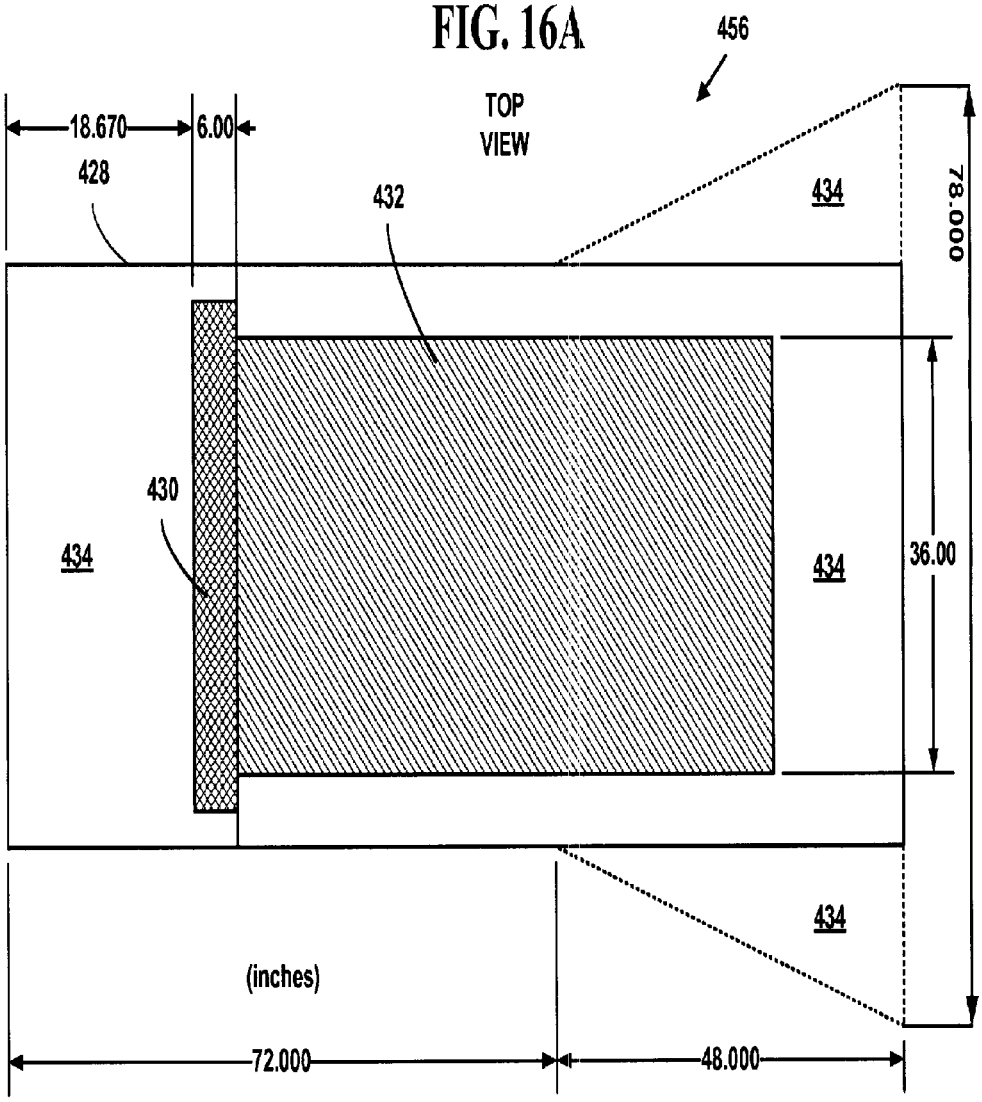
FIGS. 16A, 16B and 16C are block diagrams illustrating additional details and dimensions of an exemplary artificial pitching mound surface.
Figure 16B:
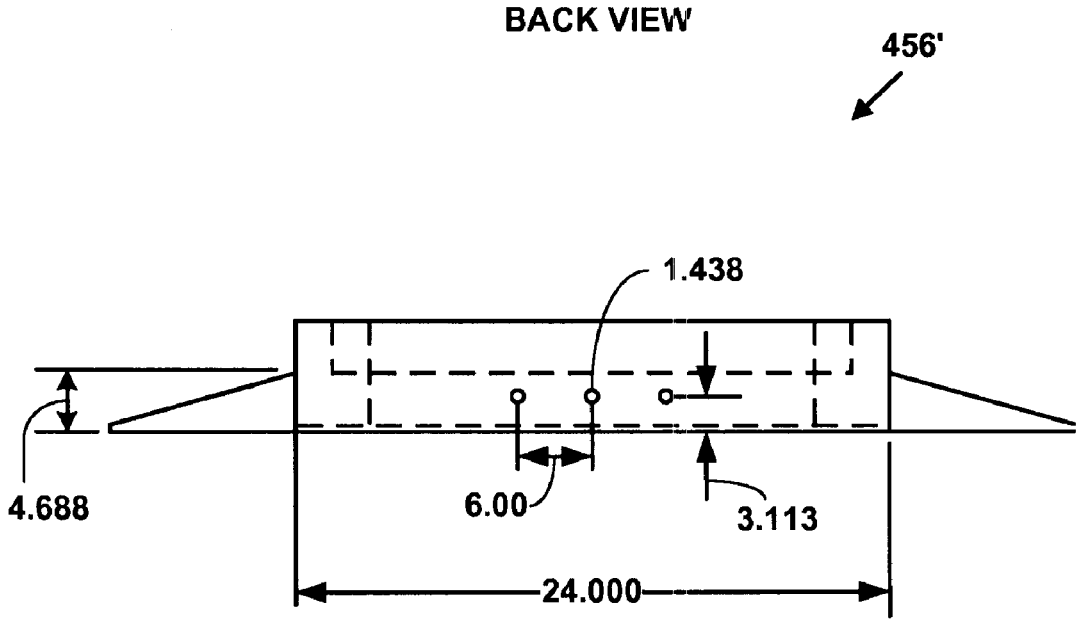
Figure 16C:
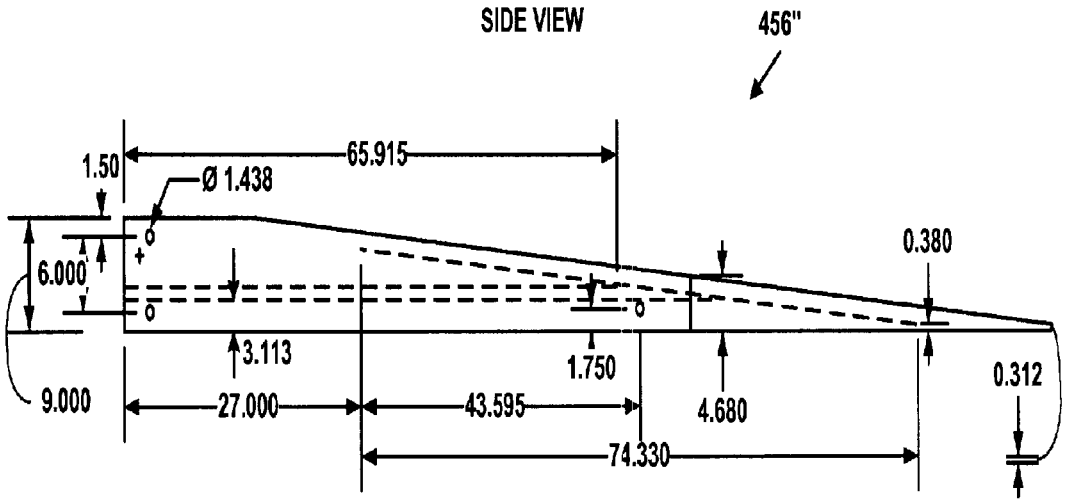

FIGS. 16A, 16B and 16C are block diagrams 456, 456' and 456" illustrating additional details and dimensions of an exemplary artificial pitching mound surface. FIGS. 16A, 16B, and 16C illustrate exemplary details and dimensions only. However, the present invention is not limited to such an exemplary embodiment and other dimensions can also be used to practice the invention.

Figure 17:
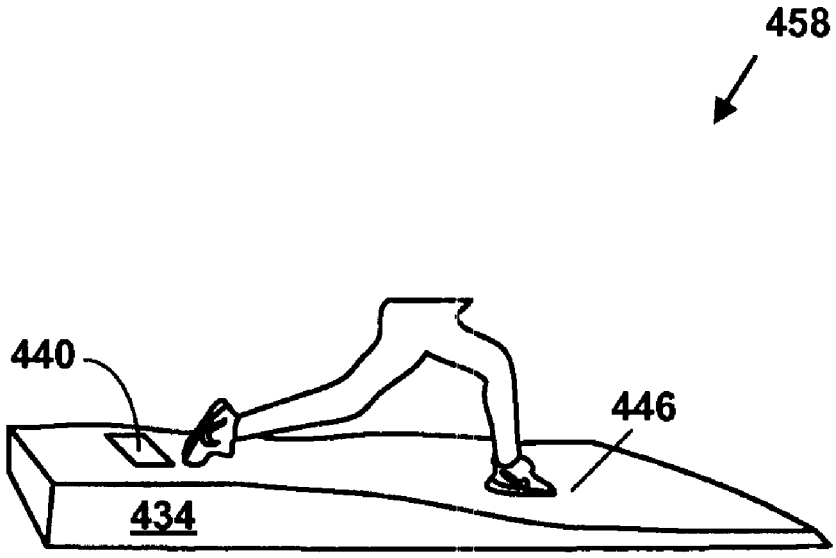
FIG. 17 is a side view of the artificial pitching mound apparatus.

FIG. 17 is a side view 458 of the artificial pitching mound apparatus 438.

In the embodiments illustrated, the artificial pitching mound apparatus 438 is illustrated as rectangular or trapezoidal in shape. In another embodiment, the artificial pitching mound apparatus 428 is constructed as a regulation pitching mound with regulation slope and round shape. In such an embodiment the pitching stride component 432 comprises a round shape.

The artificial pitching mound does not require the application of a vacuum to the filler-containing compartments to maintain a desired configuration sized and shaped by an athlete. The desired size and shape of is maintained by the size and shape of the microbeads or pellets selected to fill the fillable components and the interaction of the surfaces of the microbeads or pellets.

It should be understood that the components described herein are not related or limited to any particular type of components unless indicated otherwise. Various types of general purpose or specialized components may be used with or perform operations in accordance with the teachings described herein.

In view of the wide variety of embodiments to which the principles of the present invention can be applied, it should be understood that the illustrated embodiments are exemplary only, and should not be taken as limiting the scope of the present invention. For example, more or fewer elements may be used in the block diagrams. The elements may be used in other orders than those described (e.g., reverse order, etc.).

The claims should not be read as limited to any particular size, dimension or component unless stated to that effect. In addition, use of the term "means" in any claim is intended to invoke 35 U.S.C. §112, paragraph 6, and any claim without the word "means" is not so intended.

Therefore, all embodiments that come within the scope and spirit of the following claims and equivalents thereto are claimed as the invention.

We claim:

1. An artificial pitching mound apparatus, comprising in combination:

an artificial pitching rubber including a first fillable component filled with a first type of microbeads of a first pre-determined size and shape, wherein interactions between individual surfaces of the first type of microbeads or pellets determines a first feel and a first resistance for the artificial pitching rubber and wherein the first type of microbead includes silicone, polystyrene, polypropylene, prolene, or composite material microbeads or combinations thereof and the artificial pitching rubber further including a cover component for covering the first fillable component;

an artificial pitching stride component including a deformable tapered fillable component filled with a plurality of microbeads of a second pre-determined size and shape, wherein the second type of microbead includes silicone, polystyrene, polypropylene, prolene or composite material microbeads or combinations thereof, the deformable tapered fillable component comprising a first higher height at a first end and tapers to a second lower height at a second end, and a second cover component for the tapered fillable component, wherein interactions between individual surfaces of the second type of microbeads of the second pre-determined size and shape determines a deformability, a second feel and a second resistance different from the first feel and resistance of the first fillable component, wherein the first fillable component and tapered fillable component absorb impacts and the tapered fillable component provides deformability thereby preventing or reducing repetitive injuries from impacting the artificial pitching stride component and prevents slipping and provides safer starting and landing surfaces than those provided by a pitching mound constructed of non-deformable non-fillable components;

an artificial mound component including the artificial pitching rubber with the first fillable component filled with a first type of microbeads of a first pre-determined size and shape on a top surface at a first end in contact with the artificial pitching stride component including the deformable tapered fillable component filled with a plurality of microbeads of a second pre-determined size and shape which slopes downward from the first end to a second end, wherein the artificial mound component exceeds a width and length of artificial pitching rubber artificial mound component by a pre-determined length and width to provide support for the artificial pitching rubber and the artificial pitching stride component; and a top surface layer of the artificial pitching mound apparatus including artificial grass with plurality of groups of fibers that have been tufted on a porous backing that resemble real grass and wherein the plurality of groups of fibers are water resistant and the porous backing insures the proper water drainage from the top surface layer and off the artificial pitching mound apparatus.

2. The artificial pitching mound apparatus of claim 1 further including pellets for filling the artificial pitching rubber first fillable component the pellets including silicone, dacron, polystyrene, polypropylene, prolene, gortex, other plastic, rubber or composite material pellets.

3. The artificial pitching mound apparatus of claim 1 wherein the artificial pitching rubber cover component includes a cover layer of silicone, dacron, polystyrene, polypropylene, prolene, gortex, other plastic, rubber, or composite material cover component.

4. The artificial pitching mound apparatus of claim 1 wherein the top surface layer of the artificial pitching stride component includes polypropylene or nylon artificial grass with a plurality of groups of fibers that have been tufted on the porous backing and resemble real grass and wherein the groups of fibers are water resistant and the porous backing insures the proper water drainage.

5. The artificial pitching mound apparatus of claim 1 wherein the artificial pitching stride component includes a polyethylene or nylon synthetic fiber that is protected against Ultra Violet radiation.

6. The artificial pitching mound apparatus of claim 1 wherein the artificial pitching stride component is deformable, wherein a user can shape and reshape a desired deformed configuration in front of the artificial pitching rubber on the artificial pitching stride component by re-adjusting the microbeads into a desired depression configuration, wherein the desired depression configuration maintains its desired size and shape as a result of the characteristics of the microbeads.

7. The artificial pitching mound apparatus of claim 1 further including pellets for filing the artificial stride surface including silicone, dacron, polystyrene, polypropylene, prolene, gortex, other plastic, rubber or composite material pellets.

8. The artificial pitching mound apparatus of claim 1 wherein the first fillable component includes a plurality of individual fillable components separated by a plurality of dividers.

9. The artificial pitching mound apparatus of claim 1 wherein the tapered fillable component includes a plurality of individual fillable components separated by a plurality of dividers.

10. The artificial pitching mound apparatus of claim 1 wherein the tapered fillable component is filled with microbeads or pellets of varying sizes and shapes.

11. The artificial pitching mound apparatus of claim 9 wherein the plurality of individual fillable components are each filled with microbeads or pellets with pre-determined size and shape.

12. The artificial pitching mound apparatus of claim 1 wherein the tapered fillable component of artificial pitching stride component includes a tapered fillable component that is nine inches deep at the first end and tapers to less than one inch deep at the second end.

13. The artificial pitching mound apparatus of claim 1 wherein the microbeads of the first type are a same size and shape as the microbeads of the second type.

14. The artificial pitching mound apparatus of claim 1 wherein the microbeads of the first type are not a same size or shape as the microbeads of the second type.

15. The artificial pitching mound apparatus of claim 1 wherein dimensions of the artificial pitching mound apparatus includes the dimensions of a regulation pitching mound that is ten inches high, sloped one inch per foot from a back portion to a front portion.

16. The artificial pitching mound apparatus of claim 1 wherein dimensions of the artificial pitching rubber include a width of six inches wide, a depth of four inches and a length of forty-two inches.

17. The artificial pitching mound apparatus of claim 1 wherein dimensions of the artificial pitching stride component include a width of thirty-six inches and a length of seventy-four inches and depth that tapes from nine inches on a first end to less than one inch on a second end.

* * * * *